US006092759A

United States Patent [19]

Gemmell et al.

[11] Patent Number: 6,092,759

[45] Date of Patent: Jul. 25, 2000

[54] SYSTEM FOR DISPENSING CORELESS ROLLS OF PRODUCT

[75] Inventors: Bruce McLean Gemmell, Wilmington, Del.; Cleary Efton Mahaffey, Suwanee, Ga.; John Richard Skerrett, Alpharetta, Ga.; George R. Cohen; Donnie Lee Gantt, both of Marietta, Ga.; Stephen Lawrence Phelps, Lilburn, Ga.

[73] Assignee: Kimberly-Clark Worldwide, Inc., Neenah, Wis.

[21] Appl. No.: 09/138,663

[22] Filed: Aug. 24, 1998

Related U.S. Application Data

[60] Provisional application No. 60/058,272, Sep. 8, 1997.

[51] Int. Cl.[7] ..... B65H 16/06

[52] U.S. Cl. ..... 242/596.8; 242/596.2; 242/596.3; 242/596.7

[58] Field of Search ..... 242/596, 596.1, 242/596.2, 596.3, 596.4, 596.7, 596.8

[56] References Cited

U.S. PATENT DOCUMENTS

| | | | |
|---|---|---|---|
| Re. 25,828 | 8/1965 | Wooster . | |
| D. 238,462 | 1/1976 | Bauman | D6/97 |
| D. 238,466 | 1/1976 | Bauman | D6/97 |

(List continued on next page.)

FOREIGN PATENT DOCUMENTS

| | | |
|---|---|---|
| 2190806 | 6/1997 | Canada . |
| 0089933 A1 | 9/1983 | European Pat. Off. . |
| 0618159A2 | 2/1994 | European Pat. Off. . |
| 0842881A2 | 5/1998 | European Pat. Off. . |
| 2 251 202 | 6/1975 | France . |
| 1 248 002 | 9/1971 | United Kingdom . |
| 2 244 472 | 12/1992 | United Kingdom . |
| 2 276 107 | 9/1994 | United Kingdom . |
| 2 294 681 | 5/1996 | United Kingdom . |
| 93/10700 | 6/1993 | WIPO . |
| 94/27483 | 12/1994 | WIPO . |
| 95/01929 | 1/1995 | WIPO . |

(List continued on next page.)

OTHER PUBLICATIONS

JP 8196469 A (Abstract Only); Assignee: Sekisui Chem Ind Co. Ltd.; Aug. 1996.

JP 8333041 A (Abstract Only); Assignee: Taisei Tekkosho KK; Dec. 17, 1996.

JP 8333055 A (Abstract Only); Assignee: Uchinami KK; Dec. 17, 1996.

JP 9118455 A (Abstract Only); Assignee: Taisei Tekkosho KK; May 6, 1997.

JP 9216755 A (Abstrsct Only); Assignee: Yamazaki T; Aug. 19, 1997.

JP 9323849 A (Abstract Only); Assignee: Taisei Tekkosho KK; Dec. 16, 1997.

TW 293002 A (Abstract Only); Assignee: Minnesota Mining & Mfg. Co.; Dec 11, 1996.

*Primary Examiner*—Donald P. Walsh
*Assistant Examiner*—William A. Rivera
*Attorney, Agent, or Firm*—Karl V. Sidor

[57] ABSTRACT

A system for dispensing coreless rolls of product. The system includes: (1) a rotary dispenser including a frame, a mounting mechanism and a pair of cooperating plungers, each plunger including: a base, the base being fixed to the frame; a distal end, the distal end having a radius of curvature; and a central shaft, the central shaft connecting the base and the distal end and providing sufficient length so the plunger has a length at least as great as its widest dimension so the plunger is adapted to penetrate a mounting hole defined at an end of a careless roll product, and (2) a coreless roll of product that is self-supporting in the rotary dispenser, the careless roll including: a rolled web of product that is wound substantially throughout its diameter about a winding axis into a cylinder having first and second flat ends; and at least one flat end defining a mounting hole at substantially the center of the winding axis of the coreless roll, the mounting hole having a depth and having sides generally perpendicular to the end of the roll, the sides being separated by a distance that is less than the depth of the hole. The mounting hole of the coreless roll is adapted to receive a plunger from a rotary dispenser such that radial displacement of the careless roll with respect to the frame is prevented during use.

35 Claims, 10 Drawing Sheets

U.S. PATENT DOCUMENTS

| | | | |
|---|---|---|---|
| D. 316,201 | 4/1991 | Shimasaki | D6/518 |
| D. 318,770 | 8/1991 | Grisel | D6/523 |
| D. 327,798 | 7/1992 | Addison et al. | D6/523 |
| 390,084 | 9/1888 | Lane . | |
| 419,811 | 1/1890 | Zerr . | |
| 498,900 | 6/1893 | Hicks . | |
| 1,217,211 | 2/1917 | Pico . | |
| 1,229,431 | 6/1917 | Farrell . | |
| 1,778,282 | 10/1930 | Stewart . | |
| 2,049,964 | 8/1936 | Lawson . | |
| 2,232,968 | 2/1941 | Price et al. . | |
| 2,276,414 | 3/1942 | Morehouse et al. . | |
| 2,299,626 | 10/1942 | Hunt . | |
| 2,308,840 | 1/1943 | Vaughan et al. . | |
| 2,380,644 | 7/1945 | Grondona . | |
| 2,390,399 | 12/1945 | Tator et al. . | |
| 2,555,885 | 6/1951 | Hope . | |
| 2,566,883 | 9/1951 | Gove . | |
| 2,583,411 | 1/1952 | Carlin . | |
| 2,643,069 | 6/1953 | Carlin . | |
| 2,695,208 | 11/1954 | Graham . | |
| 2,726,823 | 12/1955 | Jespersen . | |
| 2,790,608 | 4/1957 | Sieven . | |
| 2,819,852 | 1/1958 | Sarro . | |
| 2,830,775 | 4/1958 | Kiesel . | |
| 2,839,346 | 6/1958 | Lawalin . | |
| 2,845,231 | 7/1958 | Grettve . | |
| 2,849,191 | 8/1958 | Gadler . | |
| 2,872,263 | 2/1959 | Andersson . | |
| 2,873,158 | 2/1959 | Pinkham . | |
| 2,879,012 | 3/1959 | Sarro . | |
| 2,905,404 | 9/1959 | Simmons . | |
| 2,939,645 | 6/1960 | Rowlands et al. . | |
| 2,946,636 | 7/1960 | Penney . | |
| 3,004,693 | 10/1961 | Johnson | 225/77 |
| 3,029,035 | 4/1962 | Layton . | |
| 3,032,283 | 5/1962 | Wooster . | |
| 3,034,739 | 5/1962 | Barger . | |
| 3,038,598 | 6/1962 | Layton et al. | 206/58 |
| 3,045,939 | 7/1962 | Vander Waal . | |
| 3,084,006 | 4/1963 | Roemer . | |
| 3,333,909 | 8/1967 | Beker . | |
| 3,580,651 | 5/1971 | Gauper . | |
| 3,729,145 | 4/1973 | Koo et al. . | |
| 3,791,601 | 2/1974 | Broden . | |
| 3,794,253 | 2/1974 | Megdall . | |
| 3,799,467 | 3/1974 | Bauman . | |
| 3,802,639 | 4/1974 | Dowd, Jr. . | |
| 3,823,887 | 7/1974 | Gerstein . | |
| 3,826,361 | 7/1974 | Heckrodt | 206/409 |
| 3,830,143 | 8/1974 | Dowd, Jr. | 23/84 FF |
| 3,853,279 | 12/1974 | Gerstein . | |
| 3,856,226 | 12/1974 | Dowd, Jr. . | |
| 3,878,998 | 4/1975 | Lazzari . | |
| 4,013,236 | 3/1977 | Perrin . | |
| 4,013,240 | 3/1977 | Perrin . | |
| 4,032,077 | 6/1977 | Baselice . | |
| 4,113,195 | 9/1978 | Theunissen . | |
| 4,191,307 | 3/1980 | LeCaire, Jr. et al. | 221/45 |
| 4,274,573 | 6/1981 | Finkelstein | 225/106 |
| 4,289,262 | 9/1981 | Finkelstein | 225/106 |
| 4,297,403 | 10/1981 | Smith | 428/42 |
| 4,314,679 | 2/1982 | Paul et al. . | |
| 4,383,656 | 5/1983 | Campbell . | |
| 4,410,221 | 10/1983 | Vallis et al. | 312/39 |
| 4,467,974 | 8/1984 | Crim . | |
| 4,487,378 | 12/1984 | Kobayashi . | |
| 4,513,923 | 4/1985 | Ulics . | |
| 4,535,947 | 8/1985 | Hidle . | |
| 4,583,642 | 4/1986 | Blythe et al. | 206/390 |
| 4,614,312 | 9/1986 | Del Pino . | |
| 4,634,067 | 1/1987 | White . | |
| 4,659,028 | 4/1987 | Wren . | |
| 4,662,576 | 5/1987 | Paul . | |
| 4,667,890 | 5/1987 | Gietman, Jr. . | |
| 4,695,005 | 9/1987 | Gietman, Jr. . | |
| 4,757,952 | 7/1988 | Balzer . | |
| 4,760,970 | 8/1988 | Larsson et al. . | |
| 4,767,075 | 8/1988 | Peters et al. . | |
| 4,783,015 | 11/1988 | Shimizu . | |
| 4,807,825 | 2/1989 | Elsner et al. . | |
| 4,832,271 | 5/1989 | Geleziunas . | |
| 4,860,893 | 8/1989 | Kaufman | 200/390 |
| 5,065,924 | 11/1991 | Granger | 225/46 |
| 5,097,998 | 3/1992 | Shimasaki | 225/106 |
| 5,100,075 | 3/1992 | Morand . | |
| 5,161,793 | 11/1992 | Lotto et al. | 271/182 |
| 5,170,938 | 12/1992 | Dewing | 239/52 |
| 5,170,958 | 12/1992 | Brown . | |
| 5,197,727 | 3/1993 | Lotto et al. | 271/183 |
| 5,205,455 | 4/1993 | Moody | 225/106 |
| 5,215,211 | 6/1993 | Eberle | 221/1 |
| 5,219,126 | 6/1993 | Schutz . | |
| 5,253,818 | 10/1993 | Craddock . | |
| 5,271,137 | 12/1993 | Schutz | 29/400.1 |
| 5,271,575 | 12/1993 | Weinert . | |
| 5,277,375 | 1/1994 | Dearwester . | |
| 5,281,386 | 1/1994 | Weinert | 265/512 |
| 5,310,129 | 5/1994 | Whittington et al. . | |
| 5,314,131 | 5/1994 | McCanless et al. . | |
| 5,352,319 | 10/1994 | Ishizu et al. | 156/446 |
| 5,362,013 | 11/1994 | Gietman, Jr. et al. | 242/521 |
| 5,366,175 | 11/1994 | Schutz | 242/597.6 |
| 5,370,336 | 12/1994 | Whittington | 242/560.2 |
| 5,370,339 | 12/1994 | Moody et al. | 242/597.6 |
| 5,372,865 | 12/1994 | Arakawa et al. | 428/40 |
| 5,385,318 | 1/1995 | Rizzuto | 242/597.8 |
| 5,386,950 | 2/1995 | Abt | 242/532 |
| 5,387,284 | 2/1995 | Moody | 118/220 |
| 5,390,875 | 2/1995 | Gietman, Jr. et al. | 242/521 |
| 5,402,960 | 4/1995 | Oliver et al. | 242/527.1 |
| 5,407,509 | 4/1995 | Ishizu et al. | 156/184 |
| 5,421,536 | 6/1995 | Hertel et al. | 242/526.1 |
| 5,439,187 | 8/1995 | Shimizu | 242/541.7 |
| 5,451,013 | 9/1995 | Schutz | 242/597.4 |
| 5,453,070 | 9/1995 | Moody | 493/288 |
| 5,467,935 | 11/1995 | Moody | 242/422.4 |
| 5,467,936 | 11/1995 | Moody | 242/525.7 |
| 5,474,436 | 12/1995 | Yamazaki | 425/103 |
| 5,480,060 | 1/1996 | Blythe | 221/63 |
| 5,495,997 | 3/1996 | Moody | 242/561 |
| 5,497,959 | 3/1996 | Johnson et al. | 242/542.2 |
| 5,505,402 | 4/1996 | Vigneau | 242/527.1 |
| 5,513,478 | 5/1996 | Abt | 53/118 |
| 5,518,200 | 5/1996 | Kaji et al. | 242/538.1 |
| 5,538,199 | 7/1996 | Biagiotti | 242/541.2 |
| 5,542,622 | 8/1996 | Biagiotti | 242/521 |
| 5,577,686 | 11/1996 | Moody | 242/597.4 |
| 5,603,467 | 2/1997 | Perini et al. | 242/521 |
| 5,609,269 | 3/1997 | Behnke et al. | 221/48 |
| 5,611,455 | 3/1997 | McCreary | 221/45 |
| 5,618,008 | 4/1997 | Dearwester et al. | 242/594.5 |
| 5,620,148 | 4/1997 | Mitchell | 242/160.4 |
| 5,620,544 | 4/1997 | Cram et al. | 156/184 |
| 5,636,812 | 6/1997 | Conner et al. | 242/559.2 |
| 5,639,046 | 6/1997 | Biagiotti | 242/541.2 |
| 5,642,810 | 7/1997 | Warner et al. | 206/389 |
| 5,660,349 | 8/1997 | Miller et al. | 242/526.1 |
| 5,669,576 | 9/1997 | Moody | 242/560.3 |
| 5,690,296 | 11/1997 | Biagiotti | 242/521 |
| 5,697,576 | 12/1997 | Bloch et al. | 242/596.8 |
| 5,722,608 | 3/1998 | Yamazaki | 242/160.1 |

| | | | |
|---|---|---|---|
| 5,725,176 | 3/1998 | Vigneau | 242/521 |
| 5,730,387 | 3/1998 | Yamazaki | 242/532.3 |
| 5,746,379 | 5/1998 | Shimizu | 242/160.1 |
| 5,794,882 | 8/1998 | Lewis | 242/423.1 |
| 5,797,559 | 8/1998 | Coffey | 242/527.6 |
| 5,839,680 | 11/1998 | Biagiotti | 242/160.1 |
| 5,848,762 | 12/1998 | Reinheimer et al. | 242/595 |
| 5,849,357 | 12/1998 | Andersson | 427/179 |
| 5,868,275 | 2/1999 | Moody | 221/33 |
| 5,868,342 | 2/1999 | Moody et al. | 242/560 |
| 5,875,985 | 3/1999 | Cohen et al. | 242/160 |
| 5,895,008 | 4/1999 | Sanders | 242/541.2 |
| 5,904,316 | 5/1999 | Dunning et al. | 242/595 |

FOREIGN PATENT DOCUMENTS

| | | |
|---|---|---|
| 95/08940 | 4/1995 | WIPO . |
| 95/13183 | 5/1995 | WIPO . |
| 96/27546 | 9/1996 | WIPO . |
| 96/28079 | 9/1996 | WIPO . |

SYSTEM FOR DISPENSING CORELESS ROLLS OF PRODUCT

This application claims benefit of provisional application No. 60/058,272 filed Sep. 8, 1997.

FIELD OF THE INVENTION

This invention pertains to the field of commercial and consumer roll format products such as, for example, absorbent paper products and which includes toilet tissue and paper towels. More specifically, this invention relates to an improved coreless roll of absorbent paper product that is formed so as to be easy to mount onto a dispenser.

BACKGROUND OF THE INVENTION

Commercial and consumer absorbent paper products such as toilet tissue and paper towels are typically distributed and dispensed in roll form, and nearly always include a hollow cylindrical core that the product is wrapped about. The core is usually some type of cardboard, which is glued together and to the product so that the core stays intact and the product does not separate from the core. The product is then dispensed by mounting the roll on a spindle, such as can be found on the ubiquitous bathroom toilet roll dispenser, that passes through or otherwise penetrates the inner space of the core. Some dispensers include pegs that penetrate the hollow space within the core for only a limited extent, as demonstrated in U.S. Pat. Nos. 390,084 and 2,905,404 to Lane and Simmons, respectively.

Recently, coreless rolls of toilet tissue have appeared on the market, primarily in Europe, that are wound throughout the entire diameter of the roll. There are advantages and disadvantages associated with the coreless rolls. Coreless rolls are ecologically superior to cored rolls because no adhesives or throwaway materials are used to make the product. In addition, more product can be provided in the space that would otherwise have been occupied by the core. Cored rolls are more expensive to manufacture than coreless rolls because of the expense of making the cores and joining the cores to the product. In addition, coreless rolls have the advantage of being less subject-to pilferage in commercial locations because of their inherent incompatibility with conventional dispensers. On the other hand, there are dispensing problems with coreless rolls that so far been difficult to overcome.

Conventional dispensing systems for coreless rolls typically include an enclosed support surface that the roll is supported on as it turns, and an opening through which the product is passed. While functional, these dispensing systems have some undesirable characteristics, including an inability to control drag resistance to withdrawal of the product, the fact that the product actually touches the inside of the dispenser, which might be considered unsanitary by some consumers, and an inability to provide 180 degree product access to the consumer. Many of the above described problems would be overcome if a dispensing system existed for mounting a coreless roll to rotate about its axis, as cored roll dispensers do, in a secure and stable manner. Unfortunately, such a dispensing has yet to be successfully developed.

One of the problems that stands in the way of the development of such a dispensing system involves how the coreless roll is mounted in the dispenser. If the roll is not centered, a rotating imbalance will be created as the roll turns. Also, the roll will be prevented from dispensing product until expiration in the event that its winding axis is not precisely centered on the dispenser. Moreover, if the roll is not mounted securely, it will be subject to pilferage and unreliable dispensing. However, since many coreless rolls have flat, unbroken side surfaces, it is difficult to locate the location of the winding axis. Other coreless rolls have shallow depressions to receive a dowel and/or pin or some other fastening system which do not provide robust and secure fastening of the coreless roll.

It is clear that a need exists for an improved system for permitting the effective dispensing of coreless rolls such as, for example, coreless rolls of absorbent consumer and commercial paper products.

SUMMARY OF THE INVENTION

The present invention addresses the problems described above by providing a system for dispensing coreless rolls of product. The system includes: (1) a rotary dispenser including a frame, a mounting means, and at least one pair of cooperating plungers, each plunger including: a base, the base being fixed to the frame; a distal end, the distal end having a radius of curvature; and a central shaft, the central shaft connecting the base and the distal end and providing sufficient length so the plunger has a length at least as great as its widest dimension so the plunger is adapted to penetrate a mounting hole defined at an end of a coreless roll product, and (2) at least one coreless roll of product that is self-supporting in the rotary dispenser, the coreless roll including: a rolled web of product that is wound substantially throughout its diameter about a winding axis into a cylinder having first and second flat ends; and at least one flat end defining a mounting hole at substantially the center of the winding axis of the coreless roll, the mounting hole having a depth and having sides generally perpendicular to the end of the roll, the sides being separated by a distance that is less than the depth of the hole. The mounting hole of the coreless roll is adapted to receive a plunger from a rotary dispenser such that radial displacement of the coreless roll with respect to the frame is prevented during use.

The mounting means for the dispenser may be, for example, an opening defined in the frame for a securing member such as a bolt. Other mounting means, such as clips, pins, screws, latches and the like may also be used.

In an embodiment of the dispensing system, the coreless roll securing means may further include a pair of opposed arms that are connected to the frame. In such an embodiment, mounted to an inner side of each arm is a plunger that includes: (1) a base, the base being fixed to the frame; (2) a distal end, the distal end having a radius of curvature; and (3) a central shaft, the central shaft connecting the base and the distal end and providing sufficient length so the plunger has a length at least as great as its widest dimension so the plunger is adapted to penetrate a depression defined at an end of a coreless roll product, whereby radial displacement of the coreless roll with respect to said frame is prevented during use.

The dispenser used in the system may further include biasing means for resiliently biasing at least one of the opposed arms toward the coreless roll. The biasing means may be in the form of at least one of the opposed arms being constructed out of a resilient material, so that arm (or arms) is configured so as to be slightly displaced when a coreless roll is secured within the dispenser.

The pair of opposed arms may be adapted to pivot apart from each other to define a loading position and pivot toward each other to define a dispensing position.

The dispenser used in the system may further include a locking means for locking the opposed arms at the dispensing position. For example, the locking means may be a cover that surrounds the opposed arms. Alternatively and/or additionally, the locking means may be any conventional locking mechanism including, but not limited to, latches, clips, pins, ratchets, jaws and the like.

The plunger may have cross-section that is circular, triangular, square, diamond, semi-circular, "X", "Y" or "T"-shaped or the like. It is desirable that the plunger has a cross-section width of at least 1 centimeter. If the plunger has a circular cross-section, it is desirable that the diameter be at least 1 centimeter.

The distal end of the plunger may have a radius of curvature and desirably defines a hemisphere. Of course, other geometries are contemplated for the shape of the distal end of the plunger. It is also contemplated that the plunger may have a narrow width or a variable width.

The distal end of the plunger should extend from its base a sufficient distance to penetrate the depression at the end of the coreless roll. Generally speaking, the distal end of the plunger extends from its base a distance that is at least equal to or greater than the width of the plunger. Desirably, that distance is from about 1.0 to about 2.0 times the width of the plunger. For example, if the plunger has a cross-section width of about 1 centimeter, it is desirable for the distal end of the plunger to extend more than about 1 centimeter or more from its base. As a further example, the distal end of the plunger may desirably extend for 1.25 centimeters, 1.5 centimeters, 1.75 centimeters, or 2.0 centimeters. Generally speaking, a greater extension of the plunger helps provides greater penetration into the depressions defined at the ends of the coreless roll product and helps to prevent pilferage of the coreless roll product from the dispenser.

In another embodiment, the dispenser used in the system may include retractable plungers. Generally speaking the dispensers used in the system may be fitted with a retractable plunger adapter or an retractable plunder element or the dispensers may be originally constructed with a retractable plunger element. Such an adapter/element may include: (1) a housing defining a central cavity and an opening at an end of the central cavity; (2) a retractable plunger having a distal end, a central shaft, and a base, the retractable plunger being configured so the base and a first portion of the central shaft is retained in the housing and the distal end and a second portion of the central shaft extends through the opening at an end of the central cavity so the plunger is adapted to penetrate a depression defined at an end of a coreless roll product; (3) resilient means in communication with the plunger, the resilient means being configured to apply a force against the plunger so the plunger is adapted to retract into the central cavity when a greater opposing force is applied against its distal end during loading and extend when the greater opposing force is removed; and (4) attachment means for securing the adapter to a core roll product dispenser.

The housing may further includes a mounting base so the adapter may be more easily attached to a core roll product dispenser.

The resilient means in communication with the plunger may be a spring, clip, sponge, elastomeric material or the like which can be compressed, wound or drawn so the plunger may be retracted and which exerts a force while compressed, wound or drawn so the plunger can be extended.

The base of the plunger may be configured to define an opening to a cavity at the interior of the plunger. The resilient means may protrude into the cavity at the interior of the plunger. For example, if the resilient means is a spring, the spring may protrude into the base of the plunger.

A retracting means in communication with the retractable plunger may be used for retracting the plunger against the force applied by the resilient means. The retracting means may be a knob, a lever and cam mechanism, a pull or the like.

In an embodiment, a locking means for holding the retractable plunger in an extended position may be included in the adapter. The locking means may be a cam, lever, ratchet, cotter pin or the like. The locking means may be activated by a key or pin.

The retractable plunger may further include a retaining means for preventing the retractable plunger from passing entirely through the opening at an end of the central cavity. This retaining means may be, for example, a flange, a lip, a pin, a wedge or similar structure.

An important element of the system of the present invention is a coreless roll of product that is self-supporting in a rotary dispenser. The roll includes a rolled web of product that is wound throughout its diameter about a winding axis into a cylinder having first and second flat ends. At least one flat end defines a mounting hole at substantially the center of the winding axis of the careless roll. The mounting hole has a depth and has sides generally perpendicular to the end of the roll. The sides are separated by a distance that is less than the depth of the hole such that the mounting hole is adapted to receive a plunger from a rotary dispenser.

The depth of the mounting hole may be at least about 5 percent of the width of the careless roll. For example, the depth of the mounting hold may be at least about 10 percent of the width of the careless roll. Generally speaking, it is desirable for the depth of the mounting hole to run from about 1 to about 2 times the width of the hole.

It is contemplated that the careless roll of product utilized in the system of the present invention may be a coreless roll that is wound substantially, but not entirely, throughout its diameter. According to the present invention, such a careless roll wound substantially throughout its diameter would lack a conventional cardboard or plastic core but would still incorporate a small opening through the roll at the center of the roll along the length of the winding axis. Coreless rolls of this type are disclosed in, for example, U.S. Pat. Nos. 5,669,576; 5,467,936; 5,387,284; 5,281,386; 5,271,575; and 5,271,137. Coreless rolls disclosed by these patents are formed by winding the roll on a mandrel and then removing the careless roll from the mandrel so the coreless roll defines a central aperture extending entirely through the roll along the length of the winding axis. The central aperture may generally serve as a mounting hole although its depth will be the entire length of the central aperture along the winding axis. Accordingly, the depth of such a mounting hole would be 100 percent or equal to the entire width of the coreless roll. The "width" of the roll refers to the distance between a first flat end of the coreless roll that defines a mounting hole and a second flat end of the coreless roll that defines a mounting hole. Desirably, each flat end of the coreless roll defines a mounting hole at substantially the center of the winding axis of the roll and at least one, and desirably each, mounting hole has a depth and has sides generally perpendicular to the end of the roll, the sides being separated by a distance that is less than the depth of the hole.

The mounting hole may have a generally circular cross-section. Alternatively, the mounting hole may have a polygonal cross-section. The cross-section may be, triangular, square, diamond, semi-circular, "X", "Y" or "T"-shaped or the like. It is desirable that the mounting hole have has a cross-section width of at least 1 centimeter. If the mounting hole has a circular cross-section, it is desirable that the diameter be at least 1 centimeter. It is contemplated that different cross sections and/or different diameter and/or different depth mounting holes may be used.

In an embodiment, the coreless roll may include a substantially permanently compressed portion at substantially the center of the winding axis of the roll and an uncompressed portion at a flat end defining the mounting hole. A section or portion of the compressed part of the roll may further include corrugations generally about the winding axis of the roll. These corrugations are generally visible when the roll is substantially depleted and essentially the compressed portion remains. In one aspect of the invention, the substantially permanently compressed portion of the roll partially decompresses as the roll becomes substantially depleted. For example, the compressed part of the roll may spring back slightly or exhibit some resilience and still be substantially permanently compressed. The slight spring or resilience may be useful to provide a force against a plunger of a rotary dispenser to help keep the roll in place and to prevent overspin. Coreless rolls of the type formed on a mandrel and having a small opening through the roll at the center of the roll along the length of the winding axis will lack a compressed portion at the center of the winding axis. Use of such coreless rolls is contemplated by the present invention although they lack the compressed core which helps provide spring or resilience to prevent overspin and to help keep a substantially depleted roll in place. The coreless roll may be a roll of an absorbent paper product. For example, the absorbent paper product may be selected from paper towel, paper tissue, paper wipers and the like. The coreless roll may be a roll of a nonwoven fabric or a textile. For example, the nonwoven fabric may be a knit material, a woven material, a flocked material, a stitch-bonded material, a meltblown fiber web, a spunbond filament web, a bonded-carded web, an air-formed web, a coformed web and/or combinations of one or more of the same. The coreless roll may be a roll of a composite material. For example, the composite material may be a laminate material, a film-textile laminate, a film-nonwoven laminate, an elastomeric composite material or the like.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION

Figure 1:
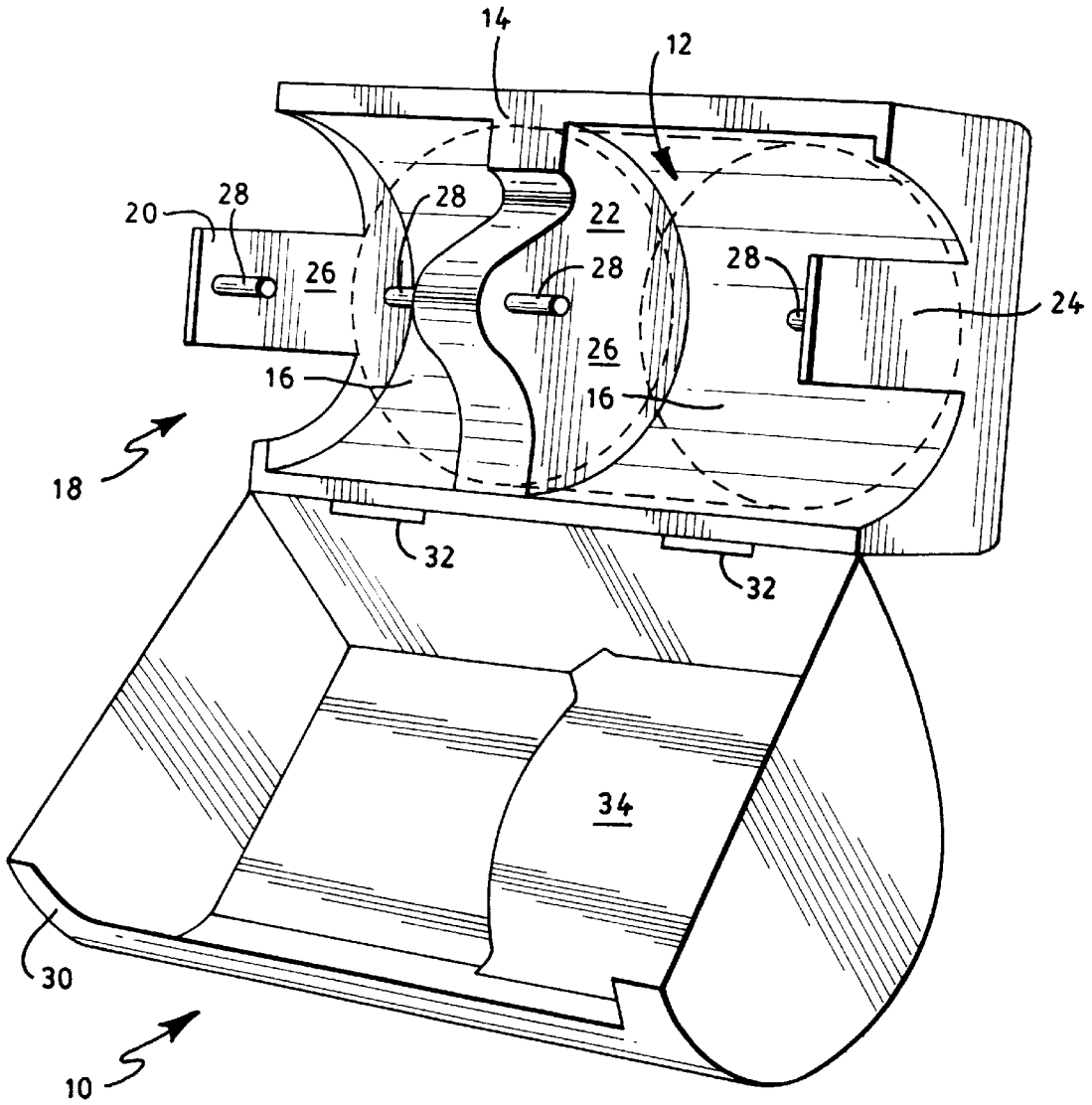
FIG. 1 is an illustration of an exemplary coreless roll product dispenser.

Referring now to the drawings, wherein like reference numerals designate corresponding structure throughout the views, and referring in particular to FIG. 1, there is shown (not necessarily to scale) an illustration of an exemplary dispenser for use in the dispensing system of the present invention. The dispenser is used to dispenser a coreless roll product having at least one and desirably a pair of mounting holes in the ends of the coreless roll.

Many different types of products may be produced in a coreless roll format. For example, commercial and consumer absorbent products such as shop towels, nonwoven fabrics, wipers, bathroom tissue and paper towels are often distributed and dispensed in roll format. There is shown at FIG. 1 a dispenser 10 for dispensing coreless roll products 12 (shown in broken lines) having a pair of mounting holes defined in the ends of the coreless roll.

The dispenser 10 includes a frame 14 that has mounting holes 16 defined therein for permitting the frame to be mounted to a stationary surface, such as a wall. The dispenser 10 further includes a coreless roll securing mechanism 18 for securing a coreless roll 12 of product (e.g., bathroom tissue) for rotation within the frame 14. In the version shown in FIGS. 1, the coreless roll securing mechanism 18 includes a first arm 20, a second, central arm 22 and a third arm 24.

While the dispenser is described in terms of an article having arms connected to a frame, it should be understood that other embodiments may be used in the system. For example, some dispensers may have sides instead of arms. In either case, the arms or sides are separated by a distance that is slightly greater than the width of the roll of the core roll product to be dispensed.

The dispenser 10 depicted in FIG. 1 is designed to accommodate two rolls of coreless roll product (e.g., bathroom tissue), much in the manner of many conventional dispensers that are available for commercial application. Desirably, the outer arms 20, 24 may be made of a resilient material, such as spring steel, and are configured so they will be slightly displaced when a coreless roll is secured between the central arm 22 and the respective outer arms 20, 24. In this way, the outer arms 20, 24 will bias the respective coreless roll 20 toward the central arm 22.

In some dispensers that may be used in the system, the outer arms 20, 24 are constructed so they are rigid and will not move. In that case, a hinge or pivot at the base of the outer arms or at some other position on the outer arms is used so the arms may be moved outward (i.e., away from the central arm 22) to a loading position and inward (i.e., toward the central arm 22) to a dispensing position.

One important advantage of the system is that the coreless roll securing mechanism 18 is designed to cooperate with the mounting holes in the coreless rolls to prevent radial displacement of the coreless rolls 12 with respect to the frame 14 of the dispenser 10 during use, so that a coreless roll can be dispensed without fear of radial displacement during use as confidently as a conventional cored roll of absorbent paper product can be dispensed. Another advantage is that the coreless roll securing mechanism cooperates with the mounting holes in the coreless rolls to make it extremely difficult to unload the roll from the dispenser until the roll is essentially depleted.

Figure 2:
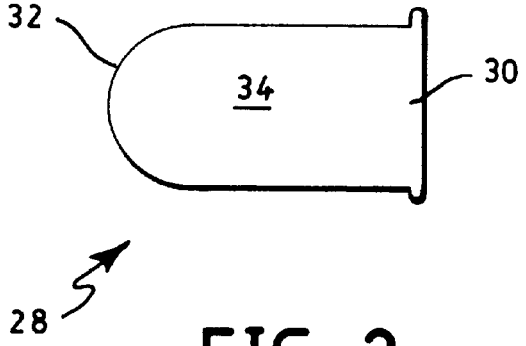
FIG. 2 is an illustration of a detail of an exemplary coreless roll product dispenser.

This is achieved by providing plungers 28 on inner surfaces 26 of the respective arms 20, 22, 24 of the securing mechanism 18. Referring now to FIG. 2, there is shown an exemplary plunger 28. Each plunger 28 is configured to have a base 30, a distal end 32 and a central shaft 34.

Generally speaking, the base 30 is affixed to the outer arms 20 and 24 and the central arm 22 of the dispenser. It is contemplated that the base 30 may be affixed to the frame in dispenser embodiments lacking arms of the type described herein. The plunger 28 may be a discrete unit and the base 30 may be adhered, joint, connected or otherwise affixed to the arms of the dispenser. For example, the base of the plunger may be attached by glues, welds, bolts, screws, pins, fasteners, clips, or other means. Alternatively, the plunger may be formed as an integral part of the outer arms, central arms or the frame by the same manufacturing techniques used to form the arms and/or frame. For example, the plunger may be formed as part of the arms and/or frame during a process such as, for example, injection molding, casting, machining, sculpting, or the like.

The distal end 32 of the plunger 28 may have a radius of curvature and desirably defines a hemisphere. The rounded tip serves as a centering device for loading the roll and eases loading by providing a leading edge. Of course, other geometries are contemplated for the shape of the distal end of the plunger.

The central shaft 34 of the plunger 28 connects the base 30 and the distal end 32 and provides sufficient length so the plunger 28 has a length at least as great as its widest dimension so the plunger is adapted to penetrate a depression defined at an end of a coreless roll product such that radial displacement of the coreless roll with respect to said frame is prevented during use.

Generally speaking, it is desirable for the plunger to have a cross-sectional width that is slightly greater than the width of the depression in the end of the coreless roll product. This configuration helps secure the roll when loaded, prevents overspin of the roll during dispensing, and assists in holding the roll as the roll is depleted. For example, if the depressions defined in both ends of the coreless roll have a diameter of slightly less than 1 centimeter (e.g., ~0.9 cm) the plunger desirably will have a diameter or width of about 1 centimeter or slightly greater than 1 centimeter.

In an embodiment of the system, it is desirable that the plunger has a cross-section width of at least 1 centimeter (approximately ½ inch). If the plunger has a circular cross-section, it is desirable that the diameter be at least 1 centimeter. Desirably, the central shaft 34 has straight, parallel sides. The straight sides of the plunger help keep the roll from wobbling during dispensing, help the roll rotate freely and avoid damage to the roll during dispensing. It is also contemplated that the plunger may have a narrow width or a variable width.

The plunger may be configured so it essentially fixed or unable to rotate about an axis. In such case, it is desirable that the plunger be constructed of materials providing low levels of friction to allow the coreless roll to rotate freely. Alternatively, the plunger may be configured so it may rotate freely. It is contemplated that the plunger may be configured so it is able to rotate with the coreless roll during dispensing.

Referring again to FIG. 1, a number of plungers 28 extend from the respective arms 20, 22, and 24 toward where the coreless roll 12 of product will be held during operation. These plungers 28 are specifically designed to penetrate the depressions defined at each end of the coreless roll to secure the coreless roll against pilferage and to prevent radial displacement of the coreless roll during use.

In embodiments of the invention where the arms 20 and 24 are constructed out of resilient material, it will be appreciated that the biasing provided by the resiliency of arms will aid the plungers 28 in penetrating depressions defined at the ends of the coreless roll and enhance the securement of the coreless rolls within the dispenser 10 during use.

In other embodiments where the arms 20 and 24 are constructed out of a rigid material and a hinge or pivot is used, a resilient means such as a spring or rubber strip may be used to help the bias the arms toward the coreless roll.

Desirably, the dispenser 10 includes a cover 30*a* that is hinged to the frame 14 by hinges 32*a*. A sliding window 34 may be provided in the cover 30 to selectively expose the roll 12 of coreless roll product that is being dispensed at a particular point in time, and to deny access to the other roll or vacated mounting location. The cover 30, hinges 32, and the sliding window 34 are conventional.

The cover 30 may also function as a locking means to help secure the coreless roll 12 in the dispenser. Closing the cover over the dispenser can prevent movement of the outer arms 20 and 24 so the coreless roll 12 cannot be unloaded and remains in place until it is depleted.

Figure 3:
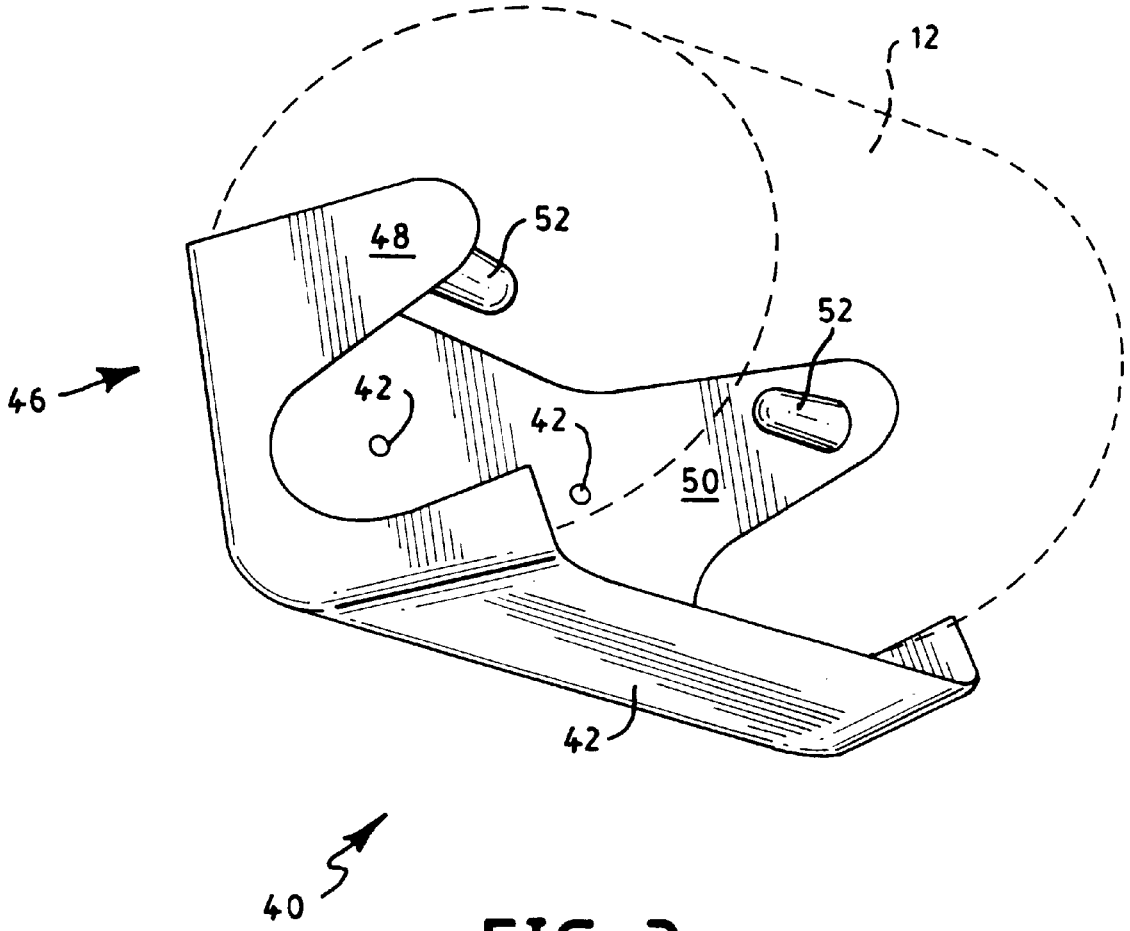
FIG. 3 is an illustration of an exemplary coreless roll product dispenser.

Referring now to FIG. 3, there is shown another embodiment of a dispenser that may be used in the dispensing system of the present invention. FIG. 3 illustrates an exemplary dispenser 40 for dispensing a coreless roll 12 of product. The dispenser 40 includes a frame 42, which is embodied as a relatively simplified shield about the space where the coreless roll 12 will be positioned during use. The frame 42 has mounting holes 44 defined in a rear portion thereof for mounting the dispenser 40 to a stationary surface, such as a wall. The dispenser 40 further includes a coreless roll securing mechanism 46 that is embodied as a first arm 48 and a second arm 50 constructed of a resilient material. A pair of plungers 52 mounted to the respective resilient arms 48, 50 are constructed and arranged to penetrate into the depressions defined at the ends of the coreless roll in the manner described above. It is contemplated that the plungers 52 may be molded, formed, cast, welded or otherwise constructed as an integral part of the arms 48 and 52 instead of being discrete units mounted on the arms.

It is also contemplated that only one of the arms needs to be configured so that it is resilient to achieve satisfactory operation of the present invention (e.g., to load of the dispenser). Desirably, both arms 48, 50 will be resilient.

Figure 4:
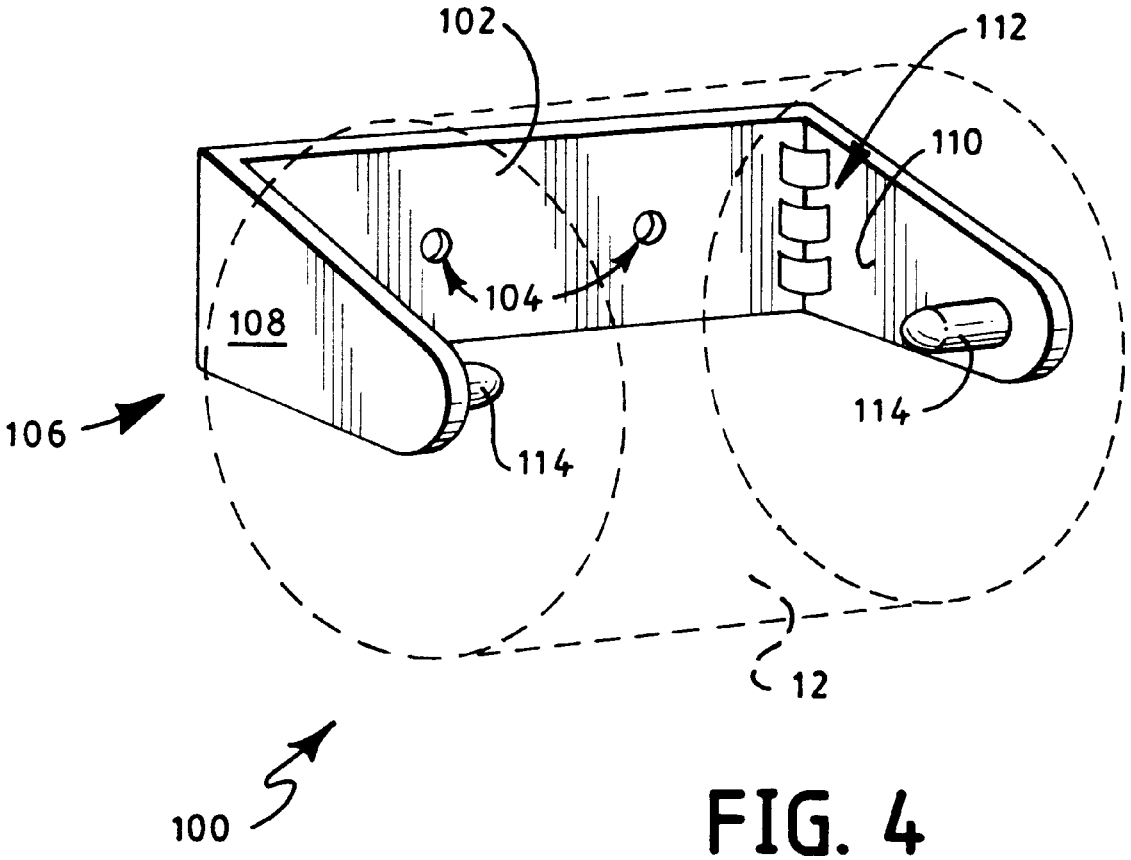
FIG. 4 is an illustration of an exemplary coreless roll product dispenser.
Figure 5:
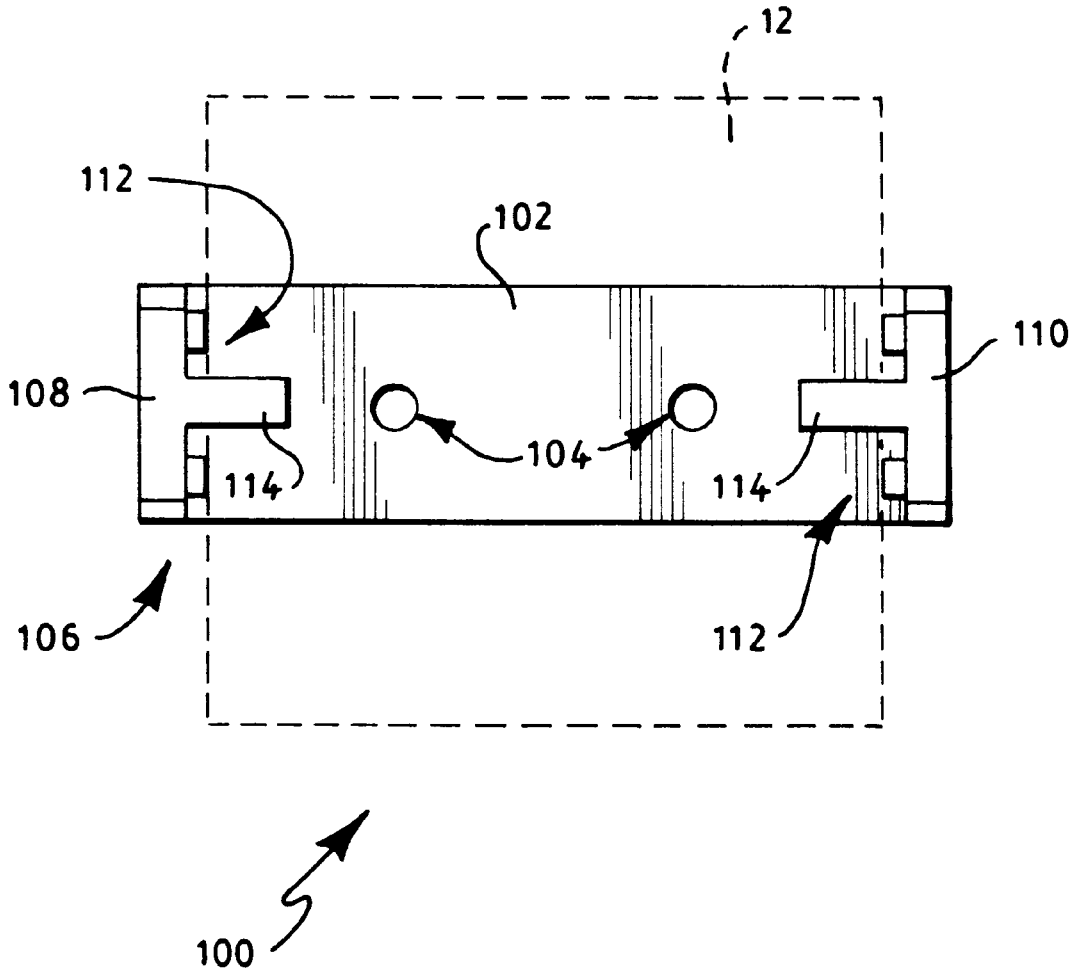
FIG. 5 is an illustration of an exemplary coreless roll product dispenser.

Referring now to FIGS. 4 and 5, there is shown another embodiment of dispensers that may be used in the dispensing system of the present invention. FIGS. 4 and 5 illustrate an exemplary dispenser 100 for dispensing a coreless roll 12 of product. The dispenser 100 includes a frame 102, which is essentially a mounting plate. The frame 102 has mounting holes 104 defined in a rear portion thereof for mounting the dispenser 100 to a stationary surface, such as a wall. The dispenser 100 further includes a coreless roll securing mechanism 106 that is embodied as a first arm 108 and a second arm 110. A pair of hinges or pivots 112 connect the first arm 108 and the second arm 110 to the frame 104.

A pair of plungers 114 mounted to the respective arms 108, 110 are constructed and arranged to penetrate into the depressions defined at the ends of the coreless roll in the manner described above. It is contemplated that the plungers 114 may be molded, formed, cast, welded or otherwise constructed as an integral part of the arms 108 and 110 instead of being discrete units mounted on the arms.

It is contemplated that only one of the arms 108, 110 needs to be configured so that it may be opened to a loading position and closed to a dispensing position to achieve satisfactory operation of the present invention (e.g., to load of the dispenser). Desirably, both of the arms 108, 110 will be configured so they hinge or pivot.

In other embodiments, a locking means for holding the arms 108, 110 in a dispensing position may be included in the dispenser. The locking means may be a cam, lever, ratchet, cotter pin or the like. The locking means may be activated by a key or pin. Such a locking means would be desirable for dispensers used in environments where pilferage of product may be encountered. The locking means on the plunger would discourage unloading of the coreless roll by making it difficult to pull the plungers out of the depressions defined in the ends of the coreless roll product.

In some embodiments of the dispensing system, the dispensers may include plungers may are retractable. Desirably, this is achieved by providing retractable plunger elements the on inner surfaces of the arms of the dispenser. Each element may be configured essentially in accordance with the construction shown in FIG. 6. As an example and with reference to FIG. 6, each element may include a housing 212 defining a central cavity 214 and an opening 216 at an end 218 of the central cavity 214. The housing may be an integral part of the respective arms 20, 22, and 24 of the securing mechanism shown in FIG. 1 or may be a discrete unit that is attached to each of the arms. Each element includes a retractable plunger 220 having a distal end 222, a central shaft 224, and a base 226. Each element also includes a resilient means 228 in communication with the plunger 220.

Figure 6:
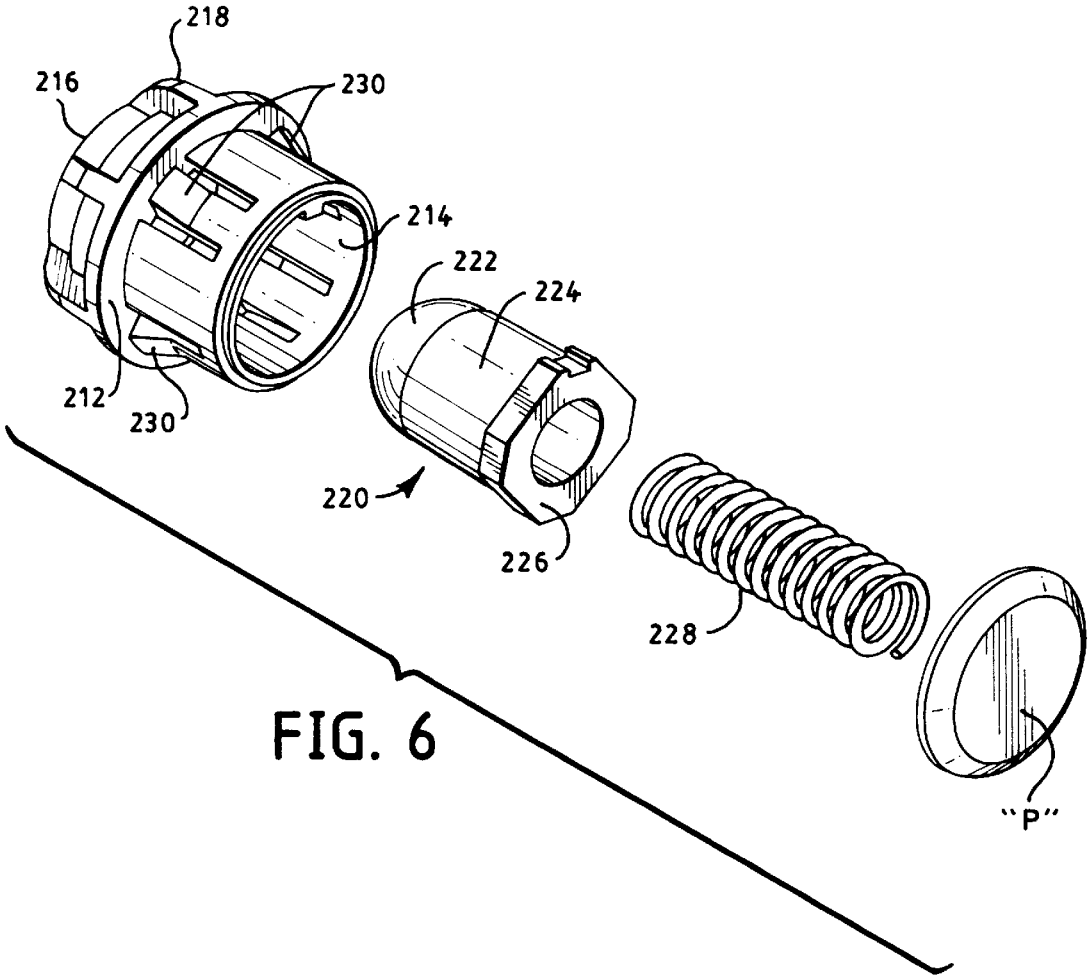
FIG. 6 is an illustration of an exemplary retractable plunger element.

The elements of the securing mechanism may optionally include an attachment means 230 as shown in FIG. 6. The attachment means may be used if the housing is constructed as a discrete unit and is not integral with the arms of the securing mechanism (i.e., if the housing is not molded, welded, constructed, formed, etc. as part of the arms of the securing mechanism).

For example, the retractable plunger elements may be constructed to include a backing plate "P" that can be attached to the housing to keep the resilient means contained within the element and to allow for convenient placement of the plunger into the central cavity of the housing. Generally speaking, the retractable plunger is configured so the base and a first portion of the central shaft is retained in the housing and the distal end and a second portion of the central shaft extends through the opening at an end of the central cavity so the plunger is adapted to penetrate a mounting hole defined at an end of a coreless roll product. The plunger may be configured so it essentially fixed or unable to rotate about an axis. In such case, it is desirable that the plunger be constructed of materials providing low levels of friction to allow the coreless roll to rotate freely. Alternatively, the plunger may be configured so it may rotate freely. It is contemplated that the plunger may be configured so it is able to rotate with the coreless roll during dispensing.

The retractable plunger may further include a retaining means for preventing the retractable plunger from passing entirely through the opening at an end of the central cavity. Generally speaking, the base of the plunger may serve as the retaining means. This may be accomplished by constructing the plunger so the width of its base is greater than the width of the opening at the end of the central cavity . This difference in physical size prevents the plunger from passing entirely through the opening. However, it is contemplated that may other types of retaining means may be used. Examples may include, but are not limited to, flanges, lips, pins, collars, rings, wedges, clips, posts, chains, leads, or similar structures or devices.

The resilient means is configured to provide or apply a force against the plunger so the plunger is adapted to retract into the central cavity when a greater opposing force is applied against its distal end during loading and extend when the greater opposing force is removed. The resilient means in communication with the plunger may be a spring, clip, sponge, elastomeric material or the like which can be compressed, wound or drawn so the plunger may be retracted and which exerts a force while compressed, wound or drawn so the plunger can be extended.

The base of the plunger may be configured to define an opening to a cavity at the interior of the plunger. The resilient means may protrude into the cavity at the interior of the plunger. For example, if the resilient means is a spring, the spring may protrude into the base of the plunger.

The dispensing system of present invention utilizes a coreless roll where the depth and/or the dimensions of the mounting hole of the coreless roll exceed the ranges previously considered practical. Such embodiments are useful to provide a coreless roll that is self-supporting when mounted in a rotary dispenser, can be made less subject to pilferage, and is more stable and provides more robust and reliable dispensing. These embodiments are particularly useful with the dispensers described above.

Figure 7:
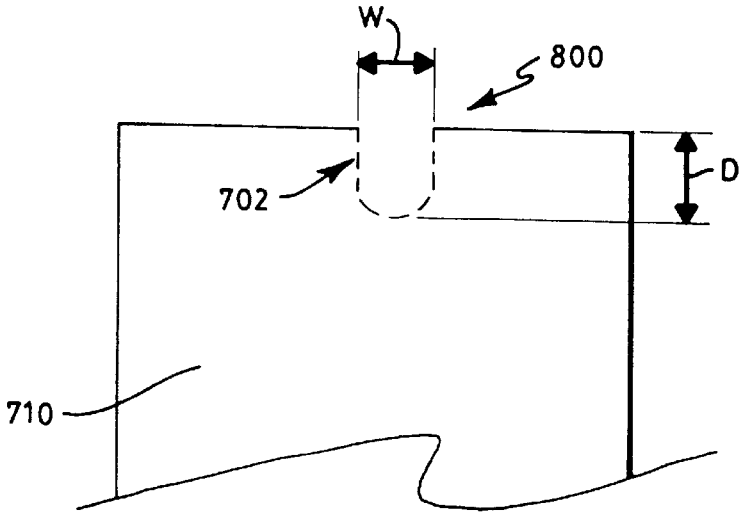
FIG. 7 is an illustration of a detail of an exemplary coreless roll of product.

This may be accomplished by treating a coreless roll of product to create a mounting hole in at least one end so the roll is self-supporting when mounted in a rotary dispenser. Referring now to FIG. 7, there is shown a cross-section view of a coreless roll 710 with a mounting hole 800. The mounting hole 800 has a width "W" and a depth "D". According to the invention, the depth "D" of the mounting hole 800 should be at least as great as the width "W" of the mounting hole 800 and is desirably greater than the width of the mounting hole. As can be seen in FIG. 7, this relationship should establish a generally parallel, axially-oriented surface at the sides 702 of the mounting hole 800. In order to provide stable, robust and reliable dispensing as well as to make the careless roll less susceptible to pilferage, it is desirable that the mounting holes have a circular cross section have a diameter ranging from about 0.25 inch to about 0.75 inch and a depth of at least about 1 times the width. Desirably, the depth may range from about 1 to about 2 times the width. It is contemplated that depths of greater than about 2 times the width may be used.

This may be accomplished by: (a) providing a roll of product that is wound throughout its diameter about a winding axis into a cylinder having first and second flat ends; (b) positioning a face of an indenting tool at substantially the center of the winding axis of the roll at least at one end; (c) pressing the face of the positioned indenting tool into the end of the roll to generate a force substantially along the winding axis sufficient to substantially permanently compress a portion of the coreless roll, leaving an uncompressed portion of the roll to define a mounting hole having a depth and having sides generally perpendicular to the end of the roll, the sides being separated by a distance that is less than the depth of the hole; and (d) removing the indenting tool from the mounting hole without substantially deforming the sides of the mounting hole.

Generally speaking, it is desirable that the roll of product, especially a roll of absorbent paper product, have a relatively high level of density. Desirably, the density or firmness of the roll will be greater than rolls of similar product wrapped around a conventional core. The density of the roll may be determined by conventional techniques. The firmness of the roll maybe determined utilizing a Firmness Tester such as, for example, a Kershaw Roll Firmness Tester, Model 4Z289B(1) available from Kershaw Instrumentation, Inc., of Swedesboro, N.J. The tester may be equipped with a standard spindle RDSA-1.40.

Figure 8:
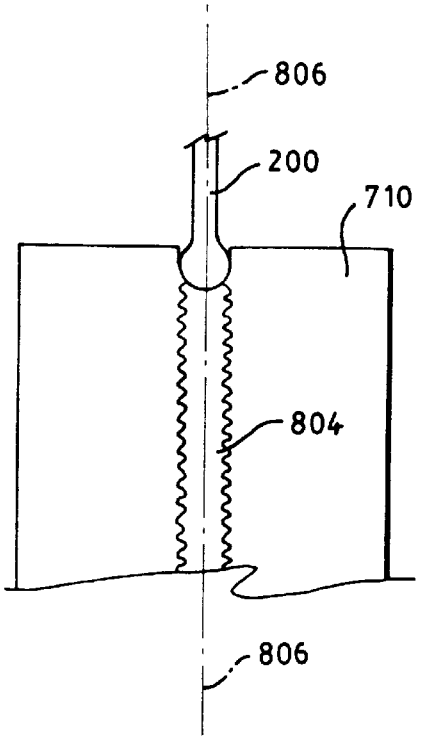
FIG. 8 is an illustration of an exemplary coreless roll depicting axial compaction.

It is important that the indenting tool is applied at substantially the center of the roll and compresses the center of the roll with a force that is substantially aligned along the winding axis of the roll. It is desirable that the force be sufficient to generate axial compaction of the center of the roll as shown in FIG. 8. In FIG. 8, a coreless roll 710 is shown with a tool 200 inserted in the roll. A central portion 804 at about the winding axis 806 is compressed axially. Generally speaking, satisfactory levels of axial compaction may be achieved with certain types of coreless rolls such as, for example, high density rolls of paper tissue, when the pressing step compresses the central portion of the roll at least 5 percent, based on the width of the roll. For example, desirable levels of axial compaction may be achieved when the pressing step compress a central portion of the roll at least 10 percent, based on the width of the roll.

Figure 9:
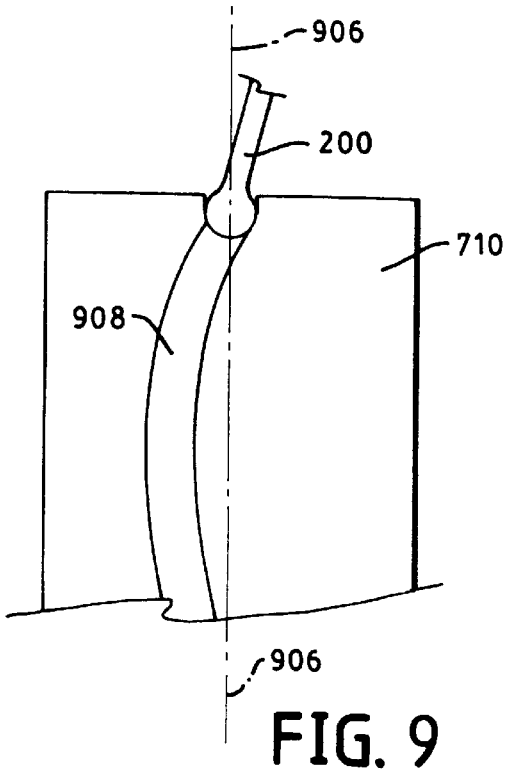
FIG. 9 is an illustration of an exemplary coreless roll depicting radial buckling.

If the compression forces are not almost completely axial, the central core will fail by bowing out to one side as shown in FIG. 9. In FIG. 9, a coreless roll 710 is shown with a tool 200 inserted in the roll. A central portion 908 at about the winding axis 906 is shown buckling out to one side. This failure may be described as radial buckling. Not only does such failure deforms the indentation shape, it may also create an off center indentation and may even deform the entire roll.

Figure 10:
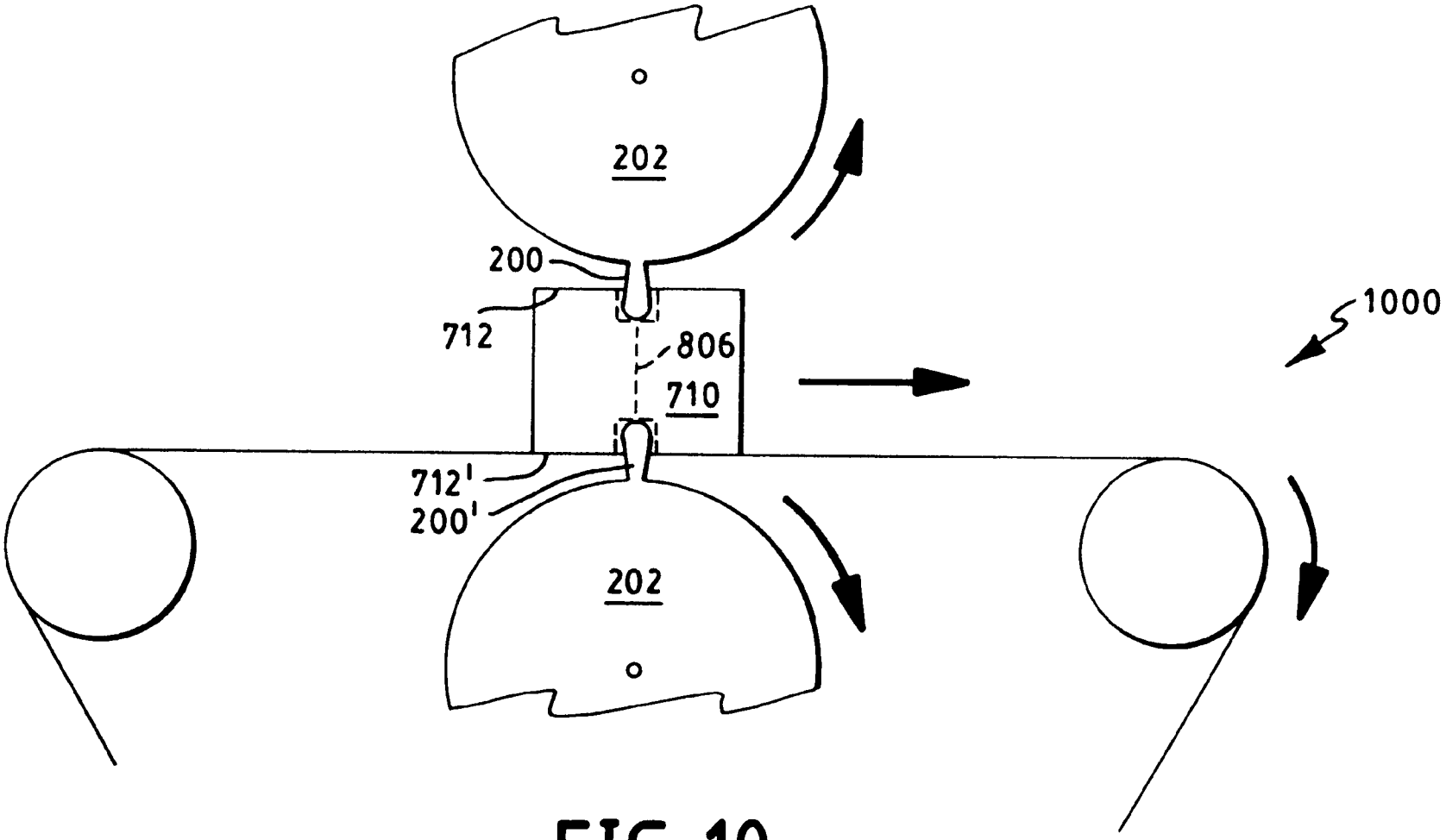
FIG. 10 is an illustration of a detail of an exemplary method of treating a coreless roll.

The indenting tool may be part of a rotating element radially mounted above and/or below the roll as it passes a treatment station. Referring now to FIG. 10, there is shown a conveyor system 1000 which carries the roll 710 in a direction as indicated by the arrows associated therewith.

A first tool 200 is part of a rotating element 202 and a second tool 200' is part of a second rotating element 202'. Each element and tool is positioned at substantially the center of the winding axis 806 of the coreless roll 710 and pressed into the flat surfaces 712 and 712' of roll as each respective element rotates in the direction of the arrows associated therewith. The rotation of the elements 202, 202' is adjusted so the tools 200, 200' track the center of the winding axis 806 of the coreless roll 710 as it is carried along by the conveyor system 1000.

Figure 11:
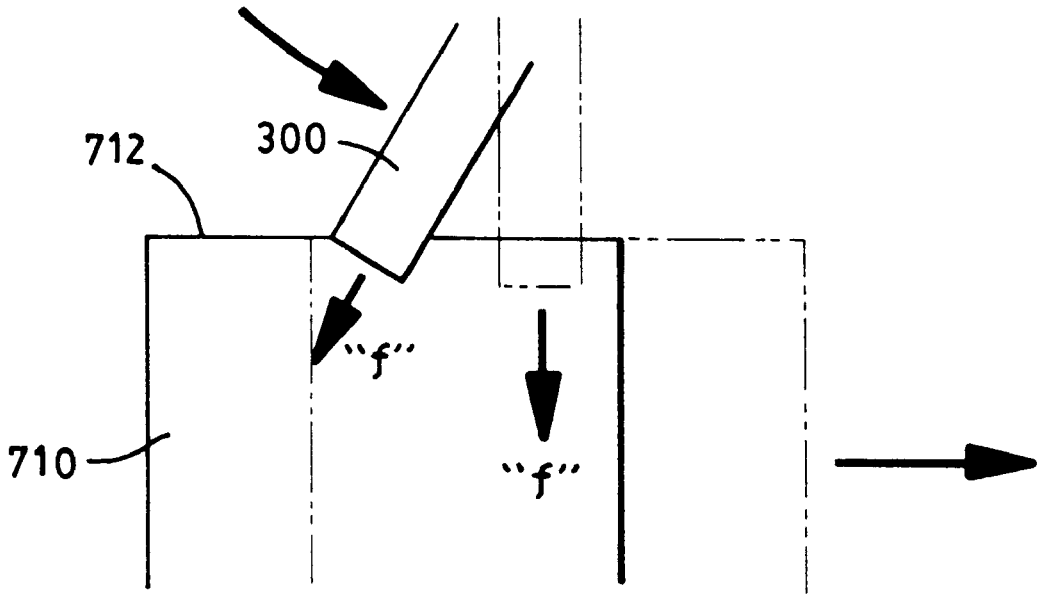
FIG. 11 is an illustration of a detail of an exemplary method of treating a coreless roll.

In such configuration, it is desirable for the face of the indenting tool to have a radius of curvature. If the face of the tool 200 was flat or conical, the tool would have a contact point the was not parallel to the flat surface 712 and 712' of the roll. This is illustrated in FIG. 11 which shows a flat-faced tool 300 as it rotates (in the direction of the arrow associated therewith) into the flat surface 712 of a coreless roll. The arrow labeled "f" extending from the flat face is intended to generally represent the direction of the force applied by the face of the tool. Note that the force is not perpendicular to the face of the roll at all times. This condition is thought to result in the failure described as radial buckling.

Figure 12:
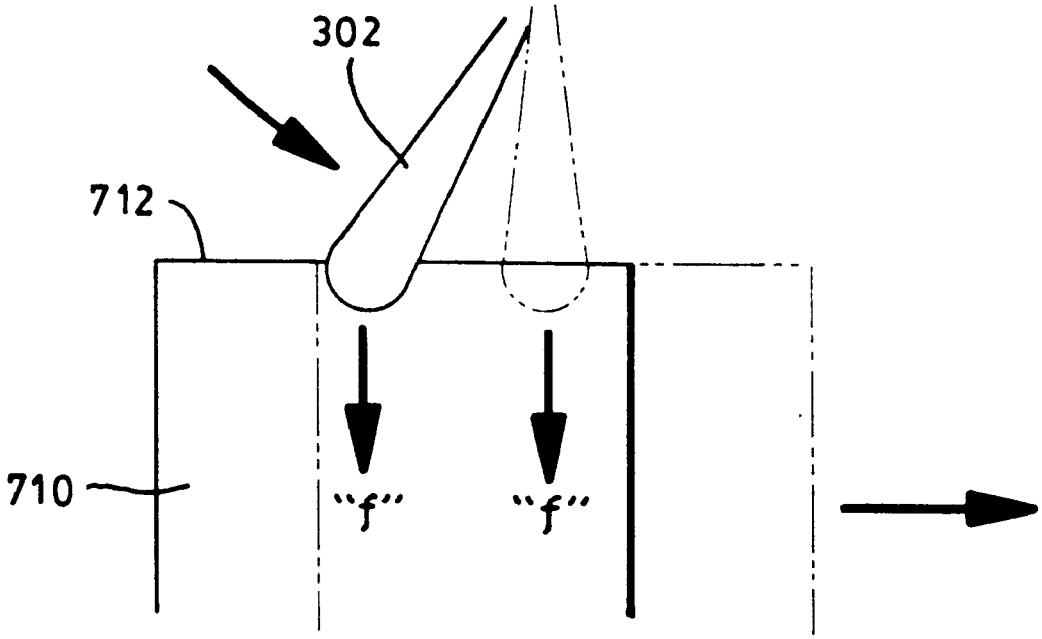
FIG. 12 is an illustration of a detail of an exemplary method of treating a coreless roll.

Referring now to FIG. 12, there is shown a radially faced tool 302 as it rotates into the flat surface 712 of a coreless roll. The arrow labeled "f" extending from the flat face is intended to generally represent the direction of the force applied by the face of the tool. Note that the force is depicted as generally perpendicular to the face of the roll at all times. This is condition is generally thought to produce the desired axial compaction of the center of the roll and avoid the failure described as radial buckling.

Figure 13:
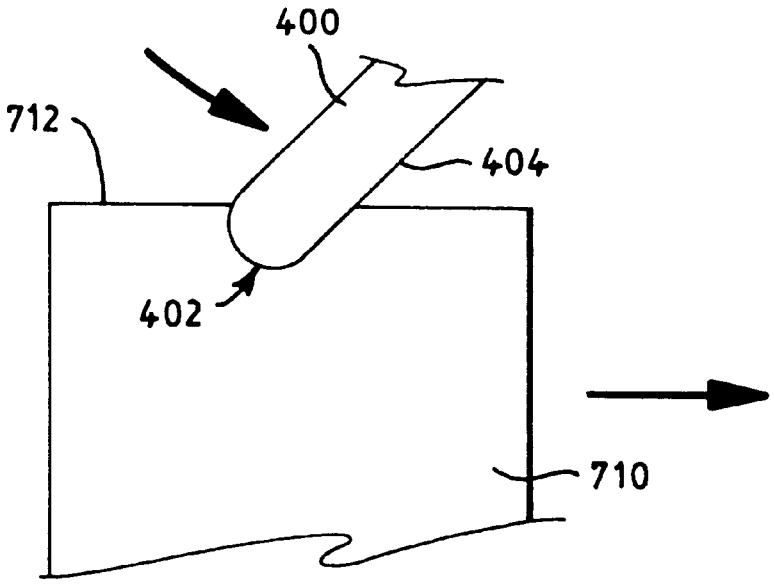
FIG. 13 is an illustration of a detail of an exemplary method of treating a coreless roll.
Figure 14:
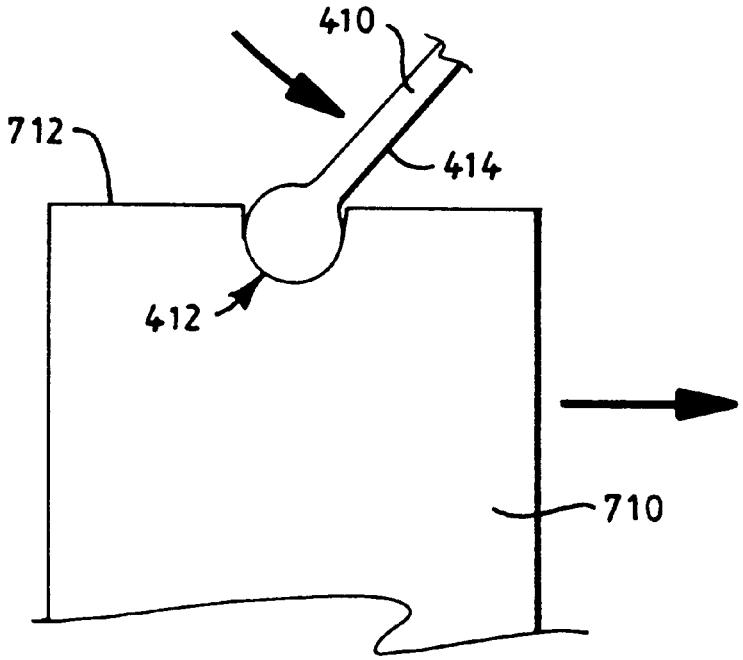
FIG. 14 is an illustration of a detail of an exemplary method of treating a coreless roll.

The profile of the indenting tool behind the contact head or face may be configured to avoid contact with the sides of the mounting hole. For example, the face of the indenting tool may be larger in cross-section or width than the portion of the tool (e.g., the stem or shaft) behind the face. This is generally illustrated in FIGS. 13 and 14. FIG. 13 shows a tool 400 with a radial face 402 and a straight stem or shaft 404 as the tool contacts the flat surface 712 of the roll 710 while the tool 400 rotates in the direction of the arrow associated therewith. As can be seen in FIG. 13, an edge of the shaft 404 well above the face 402 contacts the roll. This is more likely to be encountered when the depth of the hole is equal to or greater than the width as is specified in the dispensing system of the present invention. Contact of the edge of the shaft 404 with the flat surface of the roll typically deforms the side of the mounting hole so the roll may be difficult mount in a rotary dispenser and/or may produce buckling or deformation of the roll.

FIG. 14 is an illustration of an exemplary tool configuration which avoids this problem. A tool 410 with a radial face 412 and a narrow stem or shaft 414 contacts the flat surface 712 of the roll 710 while the tool 410 rotates in the direction of the arrow associated therewith. As can be seen in FIG. 14, the edge of the shaft 414 well above the face 412 avoids contact with the roll. This configuration permits satisfactory formation of a mounting hole wherein the depth of the hole is equal to or greater than the width as is specified in the present invention.

Figure 15A:
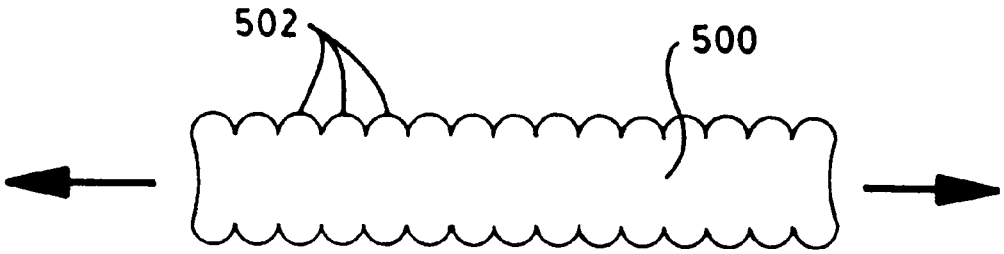
FIG. 15A is an illustration of a portion of an exemplary coreless roll depicting axial compaction.

The pressing step may create sufficient axial compression to generate corrugations generally about the winding axis of the roll over at least a portion of the substantially permanently compressed portion of the roll. This is illustrated in FIG. 15A which shows a core 500 of a substantially depleted roll exhibiting the results of axial compaction in the form of corrugations 502 generally over the entire compressed portion of the roll. As the roll is depleted, the corrugations 502 have a tendency to recover or expand the core 500 a small amount in the direction shown by the arrows associated therewith. This phenomena is an advantageous feature of an aspect of an embodiment of the system and helps keep the substantially depleted roll from popping out of a dispenser.

Figure 15B:
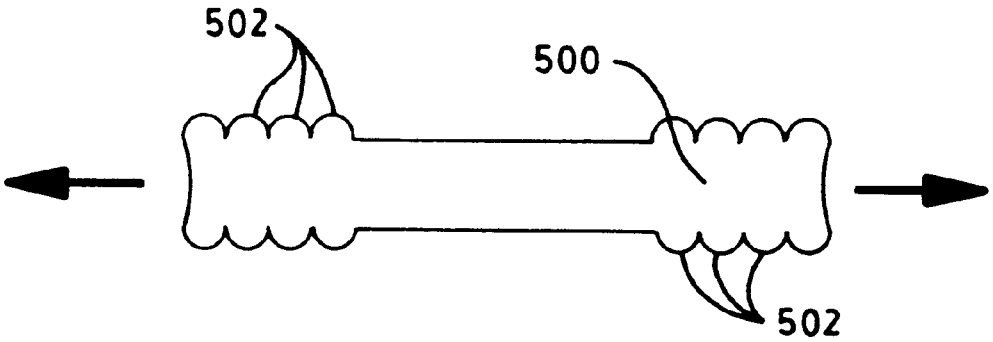
FIG. 15B is an illustration of a portion of an exemplary coreless roll depicting axial compaction.

If the dispenser is the type that has spring-loaded plungers, axial compaction helps to prevent the substantially depleted core from bowing or buckling so as to be unsuitable for further dispensing. FIG. 15B is an illustration which shows a core 500 of a substantially depleted roll exhibiting the results of axial compaction in the form of corrugations 502 generally over only small sections of the compressed portion of the roll. Generally speaking, the advantages of axial compaction may still be present even when corrugations are present only over small sections of the compressed portion of the roll.

Figure 16:
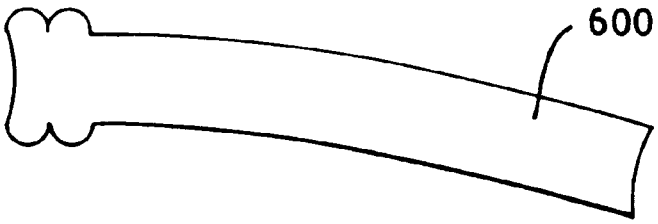
FIG. 16 is an illustration of a portion of a non-compacted coreless roll.

FIG. 16 is an illustration of a core 600 of a substantially depleted roll lacking any significant axial compaction which may appear in the form of corrugations on the compressed portion of the roll. As the roll is depleted, the non-compacted core 600 may bend or bow when subjected to pressure from spring-loaded plungers in a rotary dispenser.

Desirably, the dispensing system utilizes a coreless roll of product that is self-supporting in a rotary dispenser and is made as generally described above. The roll includes a rolled web of product that is wound throughout its diameter about a winding axis into a cylinder having first and second flat ends. At least one flat end defines a mounting hole at substantially the center of the winding axis of the coreless roll. The mounting hole has a depth and has sides generally perpendicular to the end of the roll as shown in FIG. 7. The sides are separated by a distance that is less than the depth of the hole such that the mounting hole is adapted to receive a plunger from a rotary dispenser.

The depth of the mounting hole may be at least about 5 percent of the width of the coreless roll. For example, the depth of the mounting hold may be at least about 10 percent of the width of the coreless roll. Generally speaking, it is desirable for the depth of the mounting hole to run from about 1 to about 2 times the width of the hole. Desirably, each flat end of the coreless roll defines a mounting hole at substantially the center of the winding axis of the roll and at least one, and desirably each, mounting hole has a depth and has sides generally perpendicular to the end of the roll, the sides being separated by a distance that is less than the depth of the hole.

The mounting hole or holes may have a generally circular cross-section. The mounting hole may also have a polygonal cross-section. The cross-section may be, triangular, square, diamond, semi-circular, "X", "Y" or "T"-shaped or the like. It is desirable that the mounting hole have has a cross-section width of at least 1 centimeter. If the mounting hole has a circular cross-section, it is desirable that the diameter be at least 1 centimeter. It is contemplated that different cross sections and/or different diameter and/or different depth mounting holes may be used.

In an embodiment of the invention, the coreless roll used in the dispensing system may include a substantially permanently compressed portion at substantially the center of the winding axis of the roll and an uncompressed portion at a flat end defining the mounting hole. A section or portion of the compressed part of the roll may further include corrugations generally about the winding axis of the roll as shown in FIGS. 15A and 15B. These corrugations are generally visible when the roll is substantially depleted and essentially the compressed portion remains. In one aspect of the invention, the substantially permanently compressed portion of the roll partially decompresses as the roll becomes substantially depleted as described above. For example, the compressed part of the roll may spring back slightly or exhibit some resilience and still be substantially permanently compressed. The slight spring or resilience may be useful to provide a force against a plunger of a rotary dispenser such as, for example, of the type shown in FIGS. 1–6 to help keep the roll in place and to prevent overspin.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A system for dispensing coreless rolls of product, the system comprising:

a rotary dispenser including a frame, a mounting means, and at least one pair of cooperating plungers, each plunger including:

a base, the base being fixed to the frame;

a distal end, the distal end having a radius of curvature; and a central shaft, the central shaft connecting the base and the distal end and providing sufficient length so the plunger has a length at least as great as its widest dimension so the plunger is adapted to penetrate a mounting hole defined at an end of a coreless roll product, at least one coreless roll of product supported in the rotary dispenser, the roll comprising:

a rolled web of product that is wound substantially throughout its diameter about a winding axis into a cylinder having first and second flat ends; and at least one flat end defining a mounting hole at substantially the center of the winding axis of the coreless roll, the mounting hole having a depth and having sides generally perpendicular to the end of the roll, the sides being separated by a distance that is less than the depth of the hole, wherein the mounting hole of the coreless roll is adapted to receive a plunger from a rotary dispenser and wherein radial displacement of the coreless roll with respect to said frame is prevented during use; and wherein the coreless roll is wound entirely throughout its diameter.

2. The system of claim 1, further comprising a pair of opposed arms that are connected to the frame, one of said plungers mounted to an inner side of each said arm whereby radial displacement of the coreless roll with respect to said frame is prevented during use.

3. The system of claim 2, further comprising a locking means for locking the opposed arms at the dispensing position.

4. The system of claim 1, wherein the plunger has a circular cross-section and the mounting hole of the coreless roll has a circular cross-section.

5. The system of claim 1, wherein the plunger has a cross-section diameter of at least 1 centimeter and the mounting hole of the coreless roll has a cross-section diameter of slightly less than the diameter of the plunger.

6. The system of claim 1, wherein the distal end of the plunger defines a hemisphere.

7. The system of claim 1, wherein the distal end of the plunger extends from its base a distance that is from about 1.0 to about 2.0 times the width of the plunger.

8. The system of claim 1, wherein at least one of the plungers is retractable.

9. The system of claim 1, wherein the depth of the mounting hole is at least about 5 percent of the width of the coreless roll.

10. The system of claim 1, wherein the depth of the mounting hole is at least about 10 percent of the width of the coreless roll.

11. The system of claim 1, wherein the roll includes a substantially permanently compressed portion at substantially the center of the winding axis of the roll and an uncompressed portion at a flat end defining the mounting hole.

12. The system of claim 11, wherein at least a portion of the compressed portion of the roll includes corrugations generally about the winding axis of the roll.

13. The system of claim 11, wherein the substantially permanently compressed portion of the roll partially decompresses as the roll becomes substantially depleted.

14. The system of claim 1, wherein the coreless roll of product is an absorbent paper product.

15. The system of claim 14, wherein the absorbent paper product is selected from paper towel, paper tissue, and paper wipers.

16. The system of claim 1, wherein the coreless roll of product is a nonwoven fabric.

17. The system of claim 1, wherein the coreless roll of product is a composite material.

18. A system for dispensing coreless rolls of product, the system comprising:

a rotary dispenser including a frame, a mounting means, and at least one pair of cooperating plungers, each plunger including:

a base, the base being fixed to the frame;

a distal end, the distal end having a radius of curvature; and a central shaft, the central shaft connecting the base and the distal end and providing sufficient length so the plunger has a length at least as great as its widest dimension so the plunger is adapted to penetrate a mounting hole defined at an end of a coreless roll product, at least one coreless roll of product that is self-supporting in the rotary dispenser, the roll comprising:

a rolled web of product that is wound substantially throughout its diameter about a winding axis into a cylinder having first and second flat ends; and at least one flat end defining a mounting hole at substantially the center of the winding axis of the coreless roll, the mounting hole having a depth and having sides generally perpendicular to the end of the roll, the sides being separated by a distance that is less than the depth of the hole, wherein the mounting hole of the coreless roll is adapted to receive a plunger from a rotary dispenser and wherein radial displacement of the coreless roll with respect to said frame is prevented during use;

a pair of opposed arms that are connected to the frame, one of said plungers mounted to an inner side of each said arm; and biasing means for resiliently biasing at least one of the opposed arms toward said coreless roll.

19. The system of claim 18 wherein the biasing means comprises at least one of the opposed arms being constructed out of a resilient material, and said at least one arm is configured so as to be slightly displaced when a coreless roll is secured within the dispenser.

20. A system for dispensing coreless rolls of product, the system comprising:

a rotary dispenser including a frame, a mounting means, and at least one pair of cooperating plungers, each plunder including:

a base, the base being fixed to the frame;

a distal end, the distal end having a radius of curvature; and a central shaft, the central shaft connecting the base and the distal end and providing sufficient length so the plunger has a length at least as great as its widest dimension so the plunger is adapted to penetrate a mounting hole defined at an end of a coreless roll product, at least one coreless roll of product that is self-supporting in the rotary dispenser, the roll comprising:

a rolled web of product that is wound substantially throughout its diameter about a winding axis into a cylinder having first and second flat ends; and at least one flat end defining a mounting hole at substantially the center of the winding axis of the coreless roll, the mounting hole having a depth and having sides generally perpendicular to the end of the roll, the sides being separated by a distance that is less than the depth of the hole, wherein the mounting hole of the coreless roll is adapted to receive a plunger from a rotary dispenser and wherein radial displacement of the coreless roll with respect to said frame is prevented during use;

a pair of opposed arms that are connected to the frame, one of said plungers mounted to an inner side of each said arm;

a locking means for locking the opposed arms at the dispensing position; and wherein the locking means comprises a cover that surrounds the opposed arms.

21. A system for dispensing coreless rolls of product, the system comprising:

a rotary dispenser including a frame and a mounting means for permitting the frame to be mounted to a stationary surface; and a coreless roll securing means for securing a coreless roll product for rotation within the frame, the coreless roll securing means comprising at least one element including:

a housing defining a central cavity and an opening at an end of the central cavity;

a retractable plunger having a distal end, a central shaft, and a base, the retractable plunger being configured so the base and a first portion of the central shaft is retained in the housing and the distal end and a second portion of the central shaft extends through the opening at an end of the central cavity so the plunger is adapted to penetrate a depression defined at an end of a coreless roll product; and resilient means in communication with the plunger, the resilient means being configured to apply a force against the plunger so the plunger is adapted to retract into the central cavity when a greater opposing force is applied against its distal end during loading and extend when the greater opposing force is removed, and at least one coreless roll of product that is self-supporting in the rotary dispenser, the roll comprising:

a rolled web of product that is wound substantially throughout its diameter about a winding axis into a cylinder having first and second flat ends; and at least one flat end defining a mounting hole at substantially the center of the winding axis of the coreless roll, the mounting hole having a depth and having sides generally perpendicular to the end of the roll, the sides being separated by a distance that is less than the depth of the hole, wherein the mounting hole of the coreless roll is adapted to receive a retractable plunger from a rotary dispenser and wherein radial displacement of the coreless roll with respect to said frame is prevented during use; and wherein the coreless roll is wound entirely throughout its diameter.

22. The system of claim 21, wherein the coreless roll securing means further comprises a pair of opposed arms that are connected to the frame.

23. The system of claim 21, wherein the base of the plunger defines an opening to a cavity at the interior of the plunger.

24. The system of claim 23, wherein the resilient means in communication with the plunger is a spring.

25. The system of claim 24, wherein the resilient means protrudes into the cavity at the interior of the plunger.

26. The system of claim 21, wherein the coreless roll securing means further comprises a locking means for holding the retractable plunger in an extended position.

27. The system of claim 21, wherein the retractable plunger further includes a retaining means for preventing the retractable plunger from passing entirely through the opening at an end of the central cavity.

28. The system of claim 21, wherein the depth of the mounting hole is at least about 5 percent of the width of the coreless roll.

29. The system of claim 21, wherein the depth of the mounting hole is at least about 10 percent of the width of the coreless roll.

30. The system of claim 21, wherein the roll includes a substantially permanently compressed portion at substantially the center of the winding axis of the roll and an uncompressed portion at a flat end defining the mounting hole.

31. The system of claim 30, wherein at least a portion of the compressed portion of the roll includes corrugations generally about the winding axis of the roll.

32. The system of claim 31, wherein the substantially permanently compressed portion of the roll partially decompresses as the roll becomes substantially depleted.

33. A system for dispensing coreless rolls of product, the system comprising:

a rotary dispenser including a frame and a mounting means for permitting the frame to be mounted to a stationary surface; and a coreless roll securing means for securing a coreless roll product for rotation within the frame, the coreless roll securing means comprising at least one element including:

a housing defining a central cavity and an opening at an end of the central cavity;

a retractable plunger having a distal end, a central shaft, and a base, the retractable plunger being configured so the base and a first portion of the central shaft is retained in the housing and the distal end and a second portion of the central shaft extends through the opening at an end of the central cavity so the plunger is adapted to penetrate a depression defined at an end of a coreless roll product; and resilient means in communication with the plunger, the resilient means being configured to apply a force against the plunger so the plunger is adapted to retract into the central cavity when a greater opposing force is applied against its distal end during loading and extend when the greater opposing force is removed, and at least one coreless roll of product that is self-supporting in the rotary dispenser, the roll comprising:

a rolled web of product that is wound substantially throughout its diameter about a winding axis into a cylinder having first and second flat ends; and at least one flat end defining a mounting hole at substantially the center of the winding axis of the coreless roll, the mounting hole having a depth and having sides generally perpendicular to the end of the roll, the sides being separated by a distance that is less than the depth of the hole, wherein the mounting hole of the coreless roll is adapted to receive a retractable plunger from a rotary dispenser and wherein radial displacement of the coreless roll with respect to said frame is prevented during use;

a pair of opposed arms that are connected to the frame; and biasing means for resiliently biasing at least one of the opposed arms toward the coreless roll.

34. The system of claim 33, wherein said biasing means comprises at least one of said opposed arms being constructed out of a resilient material, and said at least one arm is configured so as to be slightly displaced when a coreless roll is secured within the dispenser.

35. A system for dispensing coreless rolls of product, the system comprising:

a rotary dispenser including a frame, a mounting means, and at least one pair of cooperating plungers, each plunger including:

a base the base being fixed to the frame;

a distal end, the distal end having a radius of curvature; and a central shaft, the central shaft connecting the base and the distal end and providing sufficient length so the plunger has a length at least as great as its widest dimension so the plunger is adapted to penetrate a mounting hole defined at an end of a coreless roll product, at least one coreless roll of product that is self-supporting in the rotary dispenser, the roll comprising:

a rolled web of product that is wound substantially throughout its diameter about a winding axis into a cylinder having first and second flat ends; and at least one flat end defining a mounting hole at substantially the center of the winding axis of the coreless roll, the mounting hole having a depth and having sides generally perpendicular to the end of the roll, the sides being separated by a distance that is less than the depth of the hole, wherein the mounting hole of the coreless roll is adapted to receive a plunder from a rotary dispenser and wherein radial displacement of the coreless roll with respect to said frame is prevented during use;

a pair of opposed arms that are connected to the frame, one of said plungers mounted to an inner side of each said arm; and wherein the pair of opposed arms are adapted to pivot apart from each other to define a loading position and pivot toward each other to define a dispensing position.

* * * * *